US005651190A

United States Patent [19]

Sanders

[11] Patent Number: 5,651,190

[45] Date of Patent: Jul. 29, 1997

[54] HANDS-FREE HAIR DRYER

[76] Inventor: Deborah S. Sanders, 2000 Ewing Dr., Greensboro, N.C. 27405

[21] Appl. No.: 611,187

[22] Filed: Mar. 5, 1996

[51] Int. Cl.[6] ..... A45D 20/18

[52] U.S. Cl. ..... 34/99; 34/101

[58] Field of Search ..... 34/283, 97, 99, 34/101; 392/380, 383

[56] References Cited

U.S. PATENT DOCUMENTS

| | | | |
|---|---|---|---|
| D. 147,599 | 9/1947 | Shields | D86/10 |
| D. 155,482 | 10/1949 | Collision | D86/10 |
| 2,466,915 | 4/1949 | Shields | 34/99 |
| 2,900,739 | 8/1959 | Tofield | 34/99 |
| 3,377,715 | 4/1968 | Hübner | 34/99 |
| 3,386,184 | 6/1968 | Ponczek | 34/99 |
| 3,946,498 | 3/1976 | Waters et al. | 34/99 |
| 5,404,652 | 4/1995 | Sher | 34/97 |

*Primary Examiner*—John M. Sollecito

*Assistant Examiner*—Steve Gravini

*Attorney, Agent, or Firm*—Rhodes Coats & Bennett, L.L.P.

[57] ABSTRACT

A portable apparatus for drying the hair of a wearer. The hair dryer includes support means such as a belt or shoulder strap for removably mounting the hair dryer apparatus on the body of the wearer. A casing having an opening is mounted on the support means. A blower is disposed within the casing and is operative to force air out of the casing through an opening. A conduit is coupled with the casing with an inlet of the conduit being in communication with the opening in the casing. The conduit is arranged and configured such that an outlet thereof may be positioned proximate the hair of the wearer. The hair dryer may further include a cap member with a hole formed therein. The conduit is secured to the cap member such that the outlet is in communication with the hole. The hair dryer may be provided with a power source operative to provide electricity to the blower. The power source may include a battery mounted on the support means or an electrical cord extending from the casing. A thermal cut-off switch may be provided.

24 Claims, 3 Drawing Sheets

HANDS-FREE HAIR DRYER

FIELD OF THE INVENTION

The present invention is directed to a portable hair dryer, and more particularly to a hair dryer which may be worn on the user's body.

BACKGROUND OF THE INVENTION

Drying one's hair, often a daily routine, is generally time consuming. Other than drip drying and towel drying, there are two conventional methods for drying hair. First, hand held hair dryers may be used to sweep an airstream back and forth across the user's hair. This is a cumbersome task as it requires that the user's hand be occupied by the hair dryer and that the user pay constant attention to the task, sweeping back and forth. An alternative method of drying hair is to use a stationary hood type dryer. The hood typically fits over the hair and a blower unit forces air through a conduit and into the hood. While this method generally does not require the user's constant attention, it does prevent him or her from moving about. Accordingly, there is a need for an apparatus for drying one's hair which allows the user to move about freely without occupying the user's hand or hands. Moreover, there exists a need for such a hair drying apparatus which does not require constant or frequent manipulation by the user.

SUMMARY OF THE INVENTION

The present invention is directed to a portable apparatus for drying the hair of a wearer. The hair dryer allows the user to move about freely and, moreover, does not require that the user use his or her hands.

The hair dryer includes support means for removably mounting the hair dryer on the body of the wearer. The support means is preferably a belt adapted to be worn about the wearer's torso and/or a shoulder strap adapted to receive the wearer's shoulder. A casing having an opening is mounted on the support means. A blower is disposed within the casing and is operative to force air out of the casing through an opening in the casing. A conduit is coupled with the casing with an inlet of the conduit being in communication with the opening in the casing. The conduit is arranged and configured such that an outlet thereof may be positioned proximate the hair of the wearer.

The hair dryer may further include a cap member arranged and configured to mount on the wearer's head and cover the hair of the wearer. The cap member has a hole formed therein. The conduit is secured to the cap member such that the outlet is in communication with the hole.

The hair dryer may be provided with a battery mounted on support means and operative to power the blower. The hair dryer may include an electrical cord extending from the casing and operative to provide electricity to the blower. Preferably, a thermal cut-off switch is provided.

An object of the present invention is to provide an apparatus for drying one's hair which allows the user to move about freely.

A further object of the present invention is to provide such a hair drying apparatus which does not occupy the user's hand or hands when in use.

Yet another object of the present invention is to provide a hair dryer as discussed above which does not require constant or frequent manipulation by the user.

The preceding and further objects of the present invention will be appreciated by those of ordinary skill in the art from a reading of the Figures and the detailed description of the preferred embodiment which follow, such description being merely illustrative of the present invention.

An object of the present invention is to provide an apparatus for drying one's hair which allows the user to move about freely.

A further object of the present invention is to provide such a hair drying apparatus which does not occupy the user's hand or hands when in use.

Yet another object of the present invention is to provide a hair dryer as discussed above which does not require constant or frequent manipulation by the user.

The preceding and further objects of the present invention will be appreciated by those of ordinary skill in the art from a reading of the Figures and the detailed description of the preferred embodiment which follow, such description being merely illustrative of the present invention.

DETAILED DESCRIPTION OF THE PREFERRED EMBODIMENT

Figure 1:
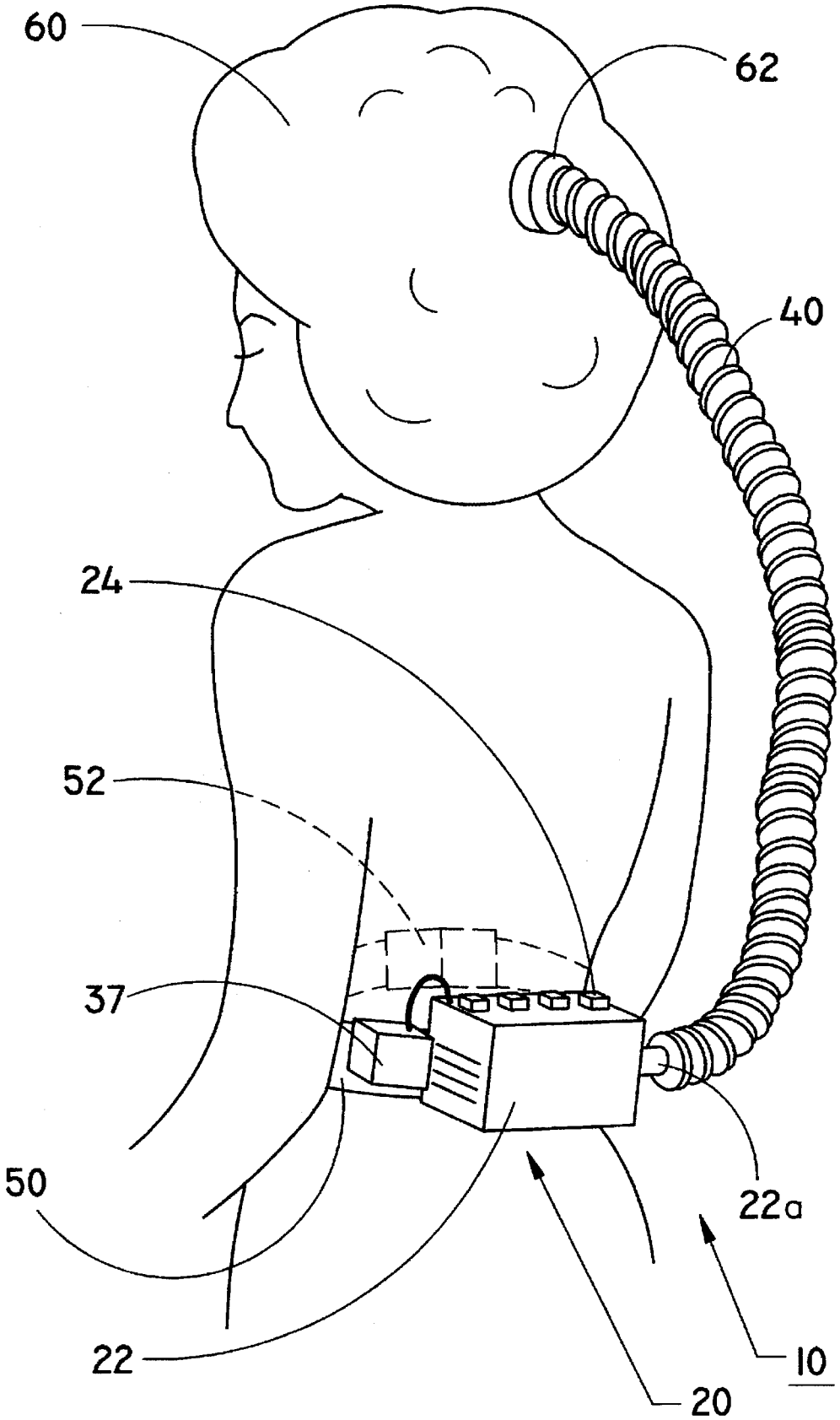
FIG. 1 is a perspective view of a hands-free hair dryer according to a first embodiment of the present invention.
Figure 2:
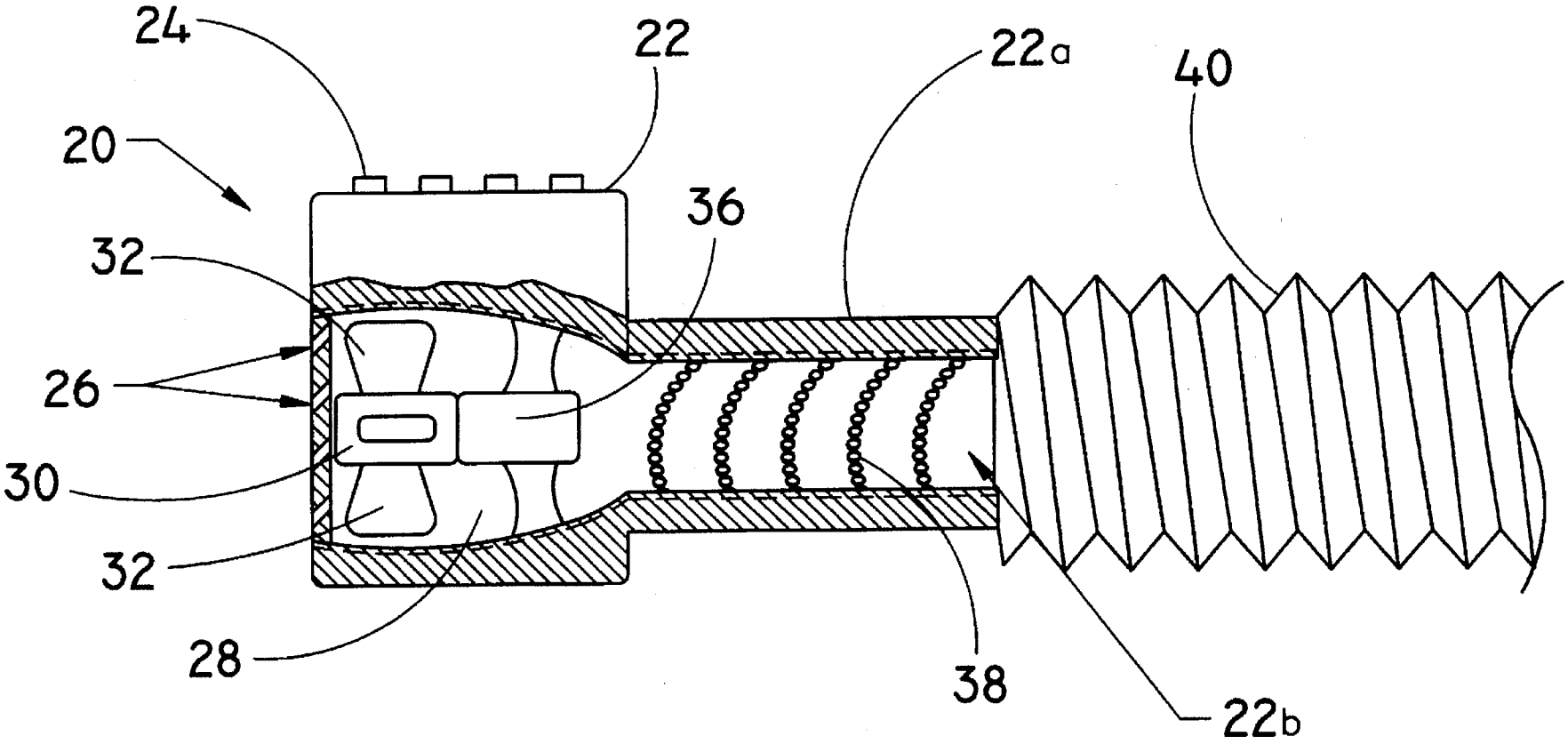
FIG. 2 is a fragmentary, side, cross sectional view of the hair dryer.

With reference to FIGS. 1 and 2, a hair dryer according to a first embodiment of the present invention, generally denoted by the numeral 10, is shown therein. Hair dryer 10 includes belt 50, blower unit 20, conduit 40, and hood 60. Belt 50 is constructed of appropriate size and shape to fit about the waist or other suitable portion of the torso of the wearer. Preferably, a buckle 52 or other suitable fastening means are provided.

Blower unit 20 includes casing 22 which is mounted on belt 50 by any suitable means such as, for example, a molded clip attachment. With reference to FIG. 2, casing 22 has cavity 28 formed therein and includes rigid tube 22A. Vent openings 26 are formed in the wall of casing 22 opposite conduit 40. Heat coils 38 are secured in tube 22A. Tube 22A is provided with opening 22B. Casing 22 is preferably formed from high temperature plastic.

With continued reference to FIG. 2, blower unit 20 includes motor 36 and fan blades 32 secured about the output shaft of motor 36. Motor 36 is preferably an electric motor, and more preferably is a 13A-125 V.A.C. (H) motor. Suitable motors include model 30080/31011 available from Johnson Electric. Conventional hand held blow dryer motors without modification or enhancement may be used.

Buttons 24 are electrically connected with motor 36 and coils 38 and are operative to control the operation of these components in conventional fashion.

Battery pack 37 houses batteries (not shown). Battery pack 37 is secured to belt 50 and is electrically connected with motor 36. It will be appreciated that the batteries may be housed in casing 22 as well. Preferably, six D cell (2 v, 2.5AH) sealed lead rechargeable batteries are provided. Suitable batteries include Cyclon batteries available from Hawker Energy Products of Warrensburg, Mo. The batteries are wired in series in line with an AC converter (preferably 120 VAC input, 12 VDC output, 1.2 AMP) (not shown) for recharging the batteries. Suitable AC converters include product number LT-10306 available from Electro-Mech Co. of Colorado Springs, Colo. A thermal cut-off unit (not shown), preferably having a trip temperature of about 243° F., may be wired in-line to provide for safety against excessive heat. Suitable thermal cut-off units include product number ECG 8115 available from Philips ECG of Williamsport, Pa.

Conduit 40 is preferably formed from a high temperature plastic material such as PBT. Conduit 40 is preferably about 2 to 2.5 feet in length to cover a range of heights as needed without compromising the heat transfer capability required to efficiently dry the hair. Conduit 40 is preferably about 1.5 to 2 inches in diameter. Hood 60 is preferably formed from polyvinyl chloride.

In operation, the user secures belt 52 about his or her waist by means of buckle 52. Hood 60 is placed over the user's head so as to cover the hair which is to be dried. Motor 36 and coils 38 are selectively energized by manipulation of buttons 24, causing fan blades 32 to draw air through vent openings 26 and force the air past heated coils 38 and out opening 22B. The air enters the inlet of conduit 40, travels through conduit 40, and finally exits the outlet of conduit 40, entering hood 60 through hole 62.

It will be appreciated from the discussion which follows that battery 70 may be replaced with an electrical cord as discussed with respect to the second embodiment, following.

Figure 3:
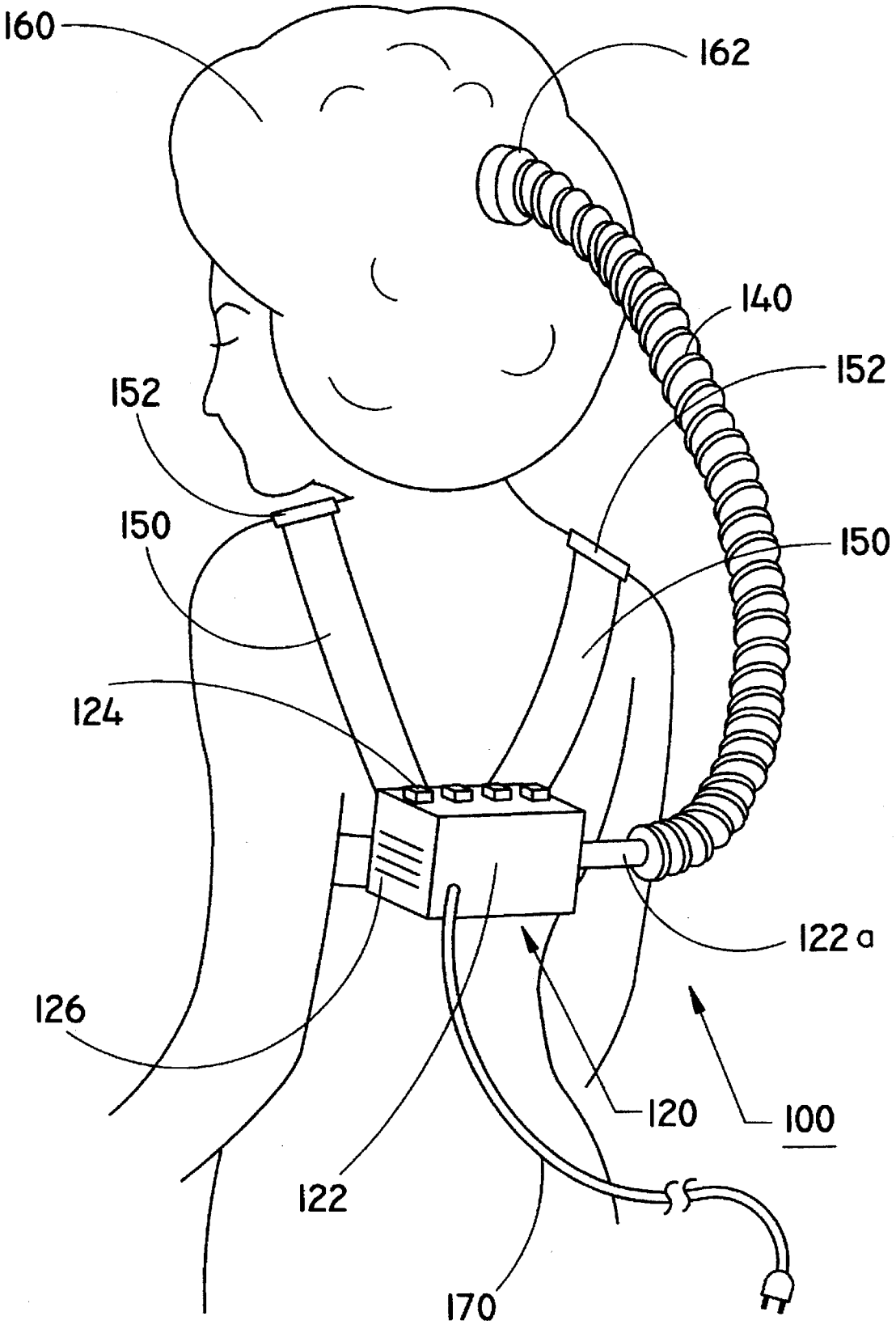
FIG. 3 is a perspective view of a hands-free hair dryer according to a second embodiment of the present invention.

With reference to FIG. 3, a hair dryer according to a second embodiment, generally denoted by the numeral 100, is shown therein. Elements 120, 122, 122A, 124, 126, 140, 160, and 162 correspond to elements 20, 22, 22A, 24, 26, 40, 60, and 62 of hair dryer 10, respectively. Further, blower unit 120 is substantially the same as blower unit 20 of the first embodiment. However, the battery of hair dryer 10 is replaced by power cord 170 which is electrically connected with the motor of blower unit 120 in conventional fashion. Preferably, power cord 170 and the motor are adapted to operate using conventional residential electricity with a suitable AC converter (not shown) provided.

Hair dryer 100 further differs from hair dryer 10 of the first embodiment in the provision of shoulder straps 150 in place of belt 50. Casing 122 is secured to straps 150 which are configured to fit about the wearer's shoulders so that hair dryer 100 may be worn in backpack fashion. Slide adjusters 152 or other suitable adjustment means are provided for adjusting the lengths of shoulder straps 150 and thus the position of blower unit 120 on the user's back.

Shoulder straps as in the second embodiment may be combined with a belt as in the first embodiment. Belt 50 and shoulder straps 150 may be formed of any suitable material, such as leather or fabric.

Apparatus and methods suitable for manufacture of the above described hair dryers will be apparent to those of ordinary skill in the art upon a reading of the foregoing descriptions.

While a preferred embodiment of the present invention has been described, it will be appreciated by those of skill in the art that certain modifications may be made without departing from the scope of the present invention. All such modifications are intended to come within the scope of claims which follow.

What is claimed is:

1. A portable apparatus for drying the hair of a wearer, comprising:

a) support means for removably mounting said hair dryer apparatus on the body of the wearer;

b) a casing mounted on said support means and having an opening;

c) a blower disposed within said casing and operative to force air out of said casing through said opening;

d) a conduit coupled with said casing having an inlet and an outlet, said inlet being in communication with said opening;

e) wherein said conduit is arranged and configured such that said outlet may be positioned proximate the hair of the wearer; and f) a battery mounted on said support means and operative to power said blower.

2. The hair drying apparatus of claim 1 wherein said support means includes a belt arranged and configured to be worn about the torso of the wearer.

3. The hair drying apparatus of claim 1 wherein said support means includes a shoulder strap adapted to receive a shoulder of the wearer.

4. The hair drying apparatus of claim 1 further including a cap member arranged and configured to mount on the wearer's head and cover the hair of the wearer, said cap member having a hole formed therein, and wherein said conduit is secured to said cap member such that said outlet is in communication with said hole.

5. The hair drying apparatus of claim 1 further including an electrical cord extending from said casing and operative to provide electricity to said blower.

6. The hair drying apparatus of claim 1 further including a thermal cut-off switch for stopping the flow of power to said hair dryer when said hair dryer attains a prescribed temperature.

7. A portable apparatus for drying the hair of a wearer, comprising:

a) support means for removably mounting said hair drying apparatus on the body of the wearer, said support means including a belt arranged and configured to be worn around the waist of the wearer;

b) a casing mounted on said belt and having an opening;

c) a blower disposed within said casing and operative to force air out of said casing through said opening;

d) a conduit coupled with said casing having an inlet and an outlet, said inlet being in communication with said opening; and e) wherein said conduit is arranged and configured such that said outlet may be positioned proximate the hair of the wearer.

8. The hair drying apparatus of claim 7 further including a cap member arranged and configured to mount on the wearer's head and cover the hair of the wearer, said cap member having a hole formed therein, and wherein said conduit is secured to said cap member such that said outlet is in communication with said hole.

9. The hair drying apparatus of claim 7 further including a battery mounted on said belt and operative to power said blower.

10. The hair drying apparatus of claim 7 further including an electrical cord extending from said casing and operative to provide electricity to said blower.

11. The hair drying apparatus of claim 7 further including a thermal cut-off switch for stopping the flow of power to said hair dryer when said hair dryer attains a prescribed temperature.

12. A portable apparatus for drying the hair of a wearer, comprising:

a) a casing having an opening;

b) support means for removably mounting said hair drying apparatus on the body of the wearer, said support means including a pair of shoulder straps, each of said shoulder straps having a pair of opposed ends attached to said casing and forming a loop adapted to receive a respective shoulder of the wearer;

c) a blower disposed within said casing and operative to force air out of said casing through said opening;

d) a conduit coupled with said casing having an inlet and an outlet, said inlet being in communication with said opening;

e) wherein said conduit is arranged and configured such that said outlet may be positioned proximate the hair of the wearer.

13. The hair drying apparatus of claim 12 further including a cap member arranged and configured to mount on the wearer's head and cover the hair of the wearer, said cap member having a hole formed therein, and wherein said conduit is secured to said cap member such that said outlet is in communication with said hole.

14. The hair drying apparatus of claim 12 further including a battery mounted on said support means and operative to power said blower.

15. The hair drying apparatus of claim 12 further including an electrical cord extending from said casing and operative to provide electricity to said blower.

16. The hair drying apparatus of claim 12 further including a thermal cut-off switch for stopping the flow of power to said hair dryer when said hair dryer attains a prescribed temperature.

17. A portable apparatus for drying the hair of a wearer, comprising:

a) support means for removably mounting said hair drying apparatus on the body of the wearer, said support means including a belt arranged and configured to be worn around the waist of the wearer;

b) a casing mounted on said belt and having an opening;

c) a blower disposed within said casing and operative to force air out of said casing through said opening;

d) a power source electrically connected with said blower and operative to provide said blower with electricity;

e) a conduit coupled with said casing having an inlet and an outlet, said inlet being in communication with said opening; and f) a cap member arranged and configured to mount on the wearer's head and cover the hair of the wearer, said cap member having a hole formed therein, and wherein said conduit is secured to said cap member such that said outlet is in communication with said hole.

18. The hair drying apparatus of claim 17 wherein said power source includes a battery mounted on said belt and operative to power said blower.

19. The hair drying apparatus of claim 17 wherein said power source includes an electrical cord extending from said casing and operative to provide electricity to said blower.

20. The hair drying apparatus of claim 17 further including a thermal cut-off switch for stopping the flow of power to said hair dryer when said hair dryer attains a prescribed temperature.

21. A portable apparatus for drying the hair of a wearer, comprising:

a) a casing having an opening;

b) support means for removably mounting said hair drying apparatus on the body of the wearer, said support means including a pair of shoulder straps, each of said shoulder straps having a pair of opposed ends attached to said casing and adapted to receive a shoulder of the wearer;

c) a blower disposed within said casing and operative to force air out of said casing through said opening;

d) a power source electrically connected with said blower and operative to provide said blower with electricity;

e) a conduit coupled with said casing having an inlet and an outlet, said inlet being in communication with said opening; and f) a cap member arranged and configured to mount on the wearer's head and cover the hair of the wearer, said cap member having an opening formed therein, and wherein said conduit is secured to said cap member such that said outlet is in communication with said hole.

22. The hair drying apparatus of claim 21 wherein said power source includes a battery mounted on said support means and operative to power said blower.

23. The hair drying apparatus of claim 21 wherein said power source includes an electrical cord extending from said casing and operative to provide electricity to said blower.

24. The hair drying apparatus of claim 21 further including a thermal cut-off switch for stopping the flow of power to said hair dryer when said hair dryer attains a prescribed temperature.

* * * * *